US009512573B2

(12) United States Patent
Austin et al.

(10) Patent No.: US 9,512,573 B2
(45) Date of Patent: Dec. 6, 2016

(54) BRIDGE TIE FASTENER SYSTEM

(71) Applicant: Lewis Bolt & Nut Company, Wayzata, MN (US)

(72) Inventors: Timothy John Austin, Rocky Ford, CO (US); David M. Barry, Greenwood, MN (US); Edward Daniel Sparks, II, Saint Johns, FL (US)

(73) Assignee: Lewis Bolt & Nut Company, Wayzata, MN (US)

( * ) Notice: Subject to any disclaimer, the term of this patent is extended or adjusted under 35 U.S.C. 154(b) by 265 days.

(21) Appl. No.: 14/465,397

(22) Filed: Aug. 21, 2014

(65) Prior Publication Data

US 2015/0053783 A1 Feb. 26, 2015

Related U.S. Application Data

(60) Provisional application No. 61/868,222, filed on Aug. 21, 2013.

(51) Int. Cl.
*E01D 19/12* (2006.01)
*E01B 26/00* (2006.01)

(52) U.S. Cl.
CPC ..... *E01B 26/00* (2013.01); *E01D 19/12* (2013.01); *Y10T 29/49948* (2015.01)

(58) Field of Classification Search
CPC ..... E01B 26/00; E01D 19/12; Y10T 29/49948
(Continued)

(56) References Cited

U.S. PATENT DOCUMENTS 2,117,717 A * 5/1938 Harmon ..... E01B 9/10 411/400
4,454,985 A 6/1984 Carter
(Continued)

FOREIGN PATENT DOCUMENTS

DE 202004001757 5/2004
JP 08-333834 12/1996
(Continued)

OTHER PUBLICATIONS

International Search Report and Written Opinion in International Application No. PCT/US2014/052132, dated Dec. 1, 2014, 21 pages.

(Continued)

*Primary Examiner* — Raymond W Addie
(74) *Attorney, Agent, or Firm* — Fish & Richardson P.C.

(57) ABSTRACT

A tie fastener apparatus for attaching railroad ties to a superstructure. The apparatus comprises a threaded hook bolt, including a hook with a hook end to engage the underside of a flange of a superstructure beam. The apparatus further includes a metal member for engaging plural ties, the metal member including a tie fastener hole at plural locations, and a nut for fastening a threaded end of the threaded hook bolt for installation when the threaded hook bolt is passed through the bolt hole and optionally a washer. When the threaded hook bolt is installed, including passing a threaded end of the threaded hook bolt through the bolt hole and fastening with the nut, the hook engages the superstructure. The apparatus is installed from above the superstructure without drilling holes in ties or the superstructure, or requiring manned installation from below the superstructure.

40 Claims, 7 Drawing Sheets

(58) Field of Classification Search
USPC ..... 14/73, 74.5, 77.1
See application file for complete search history.

(56) References Cited

U.S. PATENT DOCUMENTS

| | | | |
|---|---|---|---|
| 4,728,031 | A | 3/1988 | Heim et al. |
| 4,770,103 | A | 9/1988 | Allmer |
| 4,953,787 | A | 9/1990 | Fee |
| 5,096,119 | A | 3/1992 | Schultheiss et al. |
| 5,507,434 | A | 4/1996 | Chambers |
| 6,863,717 | B2 | 3/2005 | Johnsen et al. |
| 8,322,686 | B2 | 12/2012 | Irion et al. |

FOREIGN PATENT DOCUMENTS

| | | | | |
|---|---|---|---|---|
| JP | 2001-049620 | | 2/2001 | |
| JP | 2003-184305 | | 7/2003 | |
| JP | 2013177794 | A1 * | 9/2013 | ..... E01D 19/12 |
| KR | 10-0655861 | | 12/2006 | |
| WO | WO 2010/068801 | | 6/2010 | |
| WO | WO 2014/015395 | | 3/2014 | |

OTHER PUBLICATIONS

International Preliminary Report on Patentability in International Application No. PCT/US2014/052132, dated Mar. 3, 2016, 18 pages.

* cited by examiner

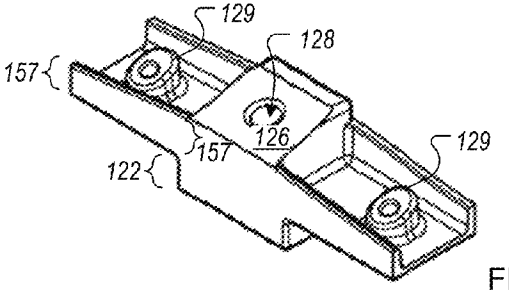
FIG. 3A
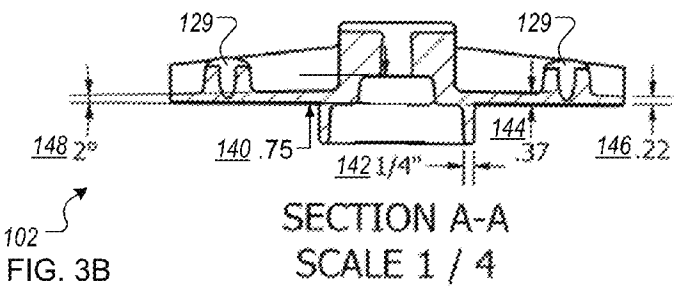
FIG. 3B
FIG. 3C
FIG. 3D
FIG. 3E
FIG. 3F

BRIDGE TIE FASTENER SYSTEM

CROSS-REFERENCE TO RELATED APPLICATION

This application claims priority to U.S. Provisional Application No. 61/868,222, filed on Aug. 21, 2013. The disclosure of the prior application is considered part of and is incorporated by reference in the disclosure of this application.

FIELD OF INVENTION

The invention relates to an improved system for securing railroad bridge open tie decks to bridge superstructures.

BACKGROUND

Bridges are an integral part of railroad infrastructure. They consist of substructure, superstructure, and deck. A common deck type is an open tie deck, which consists of evenly spaced wooden bridge ties laid transverse to the superstructure and rails. One conventional way of securing the open tie deck to steel superstructure involves drilling a hole through the bridge tie and manually feeding an L-bolt through the hole from below. The bottom leg of the L-bolt engages the bottom side of the top flange of the steel beam or girder superstructure, thus providing vertical and lateral deck securement. The installation process typically requires a railroad construction worker to scale or be suspended from the underside of the bridge or to lay on top of the deck and reach down through to ensure the L-bolt is properly positioned to make a good connection to the beam or girder flange. The vertical leg of the L-bolt is threaded on the top portion to accept a washer and nut to secure the bolt in place from the top of the bridge tie. Disadvantages of such conventional systems include ergonomic positions needed for installation and the requirement that holes be drilled in ties. These holes must be drilled near to the flange to ensure proper engagement of the L-bolt to the flange. This is very difficult to do consistently, thus sacrificing the grip of the L-bolt, while in addition setting the L-bolt up for overloading since it's not fully engaging the flange. In addition, these holes provide an access point for moisture and wood-destroying organisms to the heart of the tie, often to portions that were not able to be treated with wood preservatives, and therefore can result in accelerated rot and decomposition. The holes also require time for drilling and manual threading of the L-bolt through the holes. Further, conventional systems also require the use of a timber outer guardrail, which also requires that additional holes be drilled to secure it.

SUMMARY OF THE INVENTION

In one aspect, the invention relates to an improved bridge tie fastener system for securing open deck ties (e.g., bridge ties) to a member, such as a steel superstructure. Specifically, the bridge tie fastener system provides vertical, lateral, and longitudinal restraint of open deck bridge ties.

Key elements of the bridge tie fastener system include a modified hook bolt and a tie bracket. The hook bolt has a protrusion on one side of the hook to engage the top flange of a beam or girder. The shank of the bolt has a bend some distance from the hook. This allows the hook to engage the flange and reach above it, then have a bend to form an angle less than 90° to the hook. The other end of the hook bolt is threaded to accept a nut. Other components can be added to the system. The tie bracket is fastened to two adjacent bridge ties with nails or other fasteners such as lag screws. An (optional) protrusion from the bottom of the tie bracket can hang below top surfaces of adjacent ties. The protrusion fits between (and enforces the spacing between) the adjacent ties. It effectively locks adjacent ties together providing increased strength and resistance to longitudinal deck movement.

Key elements of the bridge tie fastener system also include a hook bolt that is installed to rest at an angle from vertical (e.g., less than 90 degrees), such as substantially equal to 75 degrees. Other angles are possible. The hook bolt takes the lateral load, e.g., preventing the bridge tie from moving side to side along its length. This is enabled in part by the installation of a tie bracket and hook bolt on the other end of the bridge tie. The hook bolt mounts to the tie bracket in a provided bolt hole between the ties and therefore does not require a hole to be drilled through the tie.

Advantages of the system include improved installation ergonomics, logistics, and speed as well as reduced need to modify bridge ties which will improve material service life. Additionally timber outer guardrail usage may be reduced or eliminated. The bridge tie fastener system can be inspected from above the bridge. The performance of the bridge tie fastener system does not substantially degrade with degradation of the tie, as opposed to a conventional hook bolt that relies on the tie securely holding the hook bolt for a significant amount of its performance.

In general, another innovative aspect of the subject matter described in this specification can be implemented in a tie fastener apparatus for attaching railroad ties to a superstructure. The apparatus comprises a threaded hook bolt, including a hook on one end of the threaded hook bolt, the hook including a hook end configured to engage the underside of a flange of a beam of the superstructure. The apparatus further comprises a metal member for engaging two or more ties, the metal member including a tie fastener hole at one or more locations. The apparatus further comprises a nut configured to be fastened to a threaded end of the threaded hook bolt for installation when the threaded hook bolt is passed through the bolt hole and optionally through a washer. When the threaded hook bolt is installed, including passing a threaded end of the threaded hook bolt through the bolt hole and fastening with the nut, the hook engages the superstructure. The tie fastener apparatus is configured to be installed from above the superstructure without drilling holes in the ties or the superstructure and without requiring manned installation from below the superstructure.

These and other implementations can each optionally include one or more of the following features. The metal member can be a tie bracket including: a center section, including the tie fastener hole for receiving the threaded hook bolt, the center section operable to engage with the threaded hook bolt for fastening to the superstructure, and two bracket ends connected to the center section, each bracket end for engaging with respective ones of adjacent ties. Bottom sides of the bracket ends can be configured, when installed, to engage with upper edges of the respective ones of adjacent ties. The metal member can be an L-shaped structural steel bar having plural bolt holes, each respective bolt hole for receiving a respective threaded hook bolt, each respective threaded hook bolt for engaging with the superstructure. The tie fastener apparatus can further include an angled washer operable for installation on a respective threaded hook bolt between the nut and the L-shaped structural steel bar. An angle of the angled washer is operable to accept a perpendicular installation of the threaded end of the respective threaded hook bolt. The shape and size of the angled washer are operable stay in position during installation. A shank of the threaded hook bolt includes a bend distal from the hook. The bend creates an angle in the threaded hook bolt, the angle being less than 90° to the hook. The shank of the threaded hook bolt can include a bend distal from the hook, the bend creating an angle in the threaded hook bolt, the angle being less than 90° to the hook. The bend can be approximately 15 degrees. The hook can have an enlarged thickness at a bend in the hook, the enlarged thickness being relative to other portions of the hook. The hook end can include a substantially flat surface having a length of approximately 2 inches and configured to engage the flange. The threaded hook bolt can include threads having thread specifications of ¾ inch and 10 UNC, and the threads can be configured to accept a nut of the same thread specifications. The shank can have an extended length, enabling installation of the hook to the flange when the threaded hook bolt is pre-positioned through the bolt hole and when the nut and the washer are pre-assembled to the threaded end of the threaded hook bolt. Each bracket end of the tie bracket can include a boss with a tie fastener hole that is vertical or at an angle relative to the tie bracket and is operable to accept a nail, a lag screw, or another fastener to secure the bracket end to a respective tie. Each bracket end of the tie bracket can include, along the bottom of the tie bracket, grooves configured to grip an upper edge of a respective tie and resist movement of the tie bracket relative to the respective tie. The center section of the tie bracket can include a flat upper surface, wherein, when the threaded hook bolt is installed in the tie bracket, the flat upper surface is substantially perpendicular to the shank at the threaded end of the threaded hook bolt, and wherein the flat upper surface is configured to engage the nut and, optionally, the washer. The center section of the tie bracket can include a protrusion that extends below bottom surfaces of the bracket ends of the tie bracket and below the top surfaces of adjacent ties, the protrusion configured to position the tie bracket between, and for the protrusion to substantially fill a space between, adjacent ties. The bracket ends of the tie bracket can include side walls extending upward from substantially flat portions of the bracket ends, the side walls providing increased strength of the bracket ends. The superstructure can be a steel superstructure of a bridge. The metal member can be a reinforced L-shaped structural steel bar. The reinforced L-shaped structural steel bar can include plural bolt holes, each respective bolt hole for receiving a respective threaded hook bolt for engaging with the superstructure, each threaded hook bolt engaged with the reinforced L-shaped structural steel bar using a nut and optionally a washer. The reinforced L-shaped structural steel bar can further include plural tie fastener holes, each respective tie fastener hole for accepting a fastener for fastening to a respective tie, each tie fastener hole operable to accept a nail, a lag screw, or another fastener to secure the reinforced L-shaped structural steel bar to a respective tie. The tie fastener apparatus can further include a boss at each of the plural bolt holes, the top surface of the boss angled relative to the respective bolt hole so that the threaded end of the threaded hook bolt is perpendicular to the top surface of the boss. The tie fastener apparatus can further include a tab end and a tab-ready end, the tab end configured to fit into the tab-ready end during installation. The tie fastener apparatus can further include stabilizers that connect, and provide structural stabilizing strength to, a bottom portion of the reinforced L-shaped structural steel bar and a side of the reinforced L-shaped structural steel bar.

In general, another innovative aspect of the subject matter described in this specification can be implemented in methods that include a computer-implemented method for attaching plural ties to a superstructure. The method includes attaching plural ties to a superstructure. The method includes installing a metal member on two or more ties. The metal member contacts the two or more ties and includes a tie fastener hole at one or more locations on the metal member and a bolt hole at one or more locations on the metal member, the bolt hole for accepting a threaded hook bolt. The method further includes, for each bolt hole, installing the threaded hook bolt. Installing the threaded hook bolt includes installing, at a hook end of the threaded hook bolt, a hook of the threaded hook bolt to an underside of a flange of a beam of the superstructure, the hook engaging the underside of the flange. Installing the threaded hook bolt further includes passing a threaded end of the threaded hook bolt through the bolt hole and optionally through a washer. Installing the threaded hook bolt further includes fastening and tightening a nut onto the threaded end of the threaded hook bolt, including causing a tightening of the hook to the underside of the flange. The method further includes, for each tie fastener hole, installing a fastener, including using a nail or a lag screw in the respective tie fastener hole to secure the metal member to the tie. Attaching the plural ties to the superstructure occurs from above the superstructure without drilling holes in the ties or the superstructure and without requiring manned installation from below the superstructure.

These and other implementations can each optionally include one or more of the following features. The metal member can be a tie bracket. The tie bracket includes a center section, including the tie fastener hole for receiving the threaded hook bolt. The center section operable to engage with the threaded hook bolt for fastening to the superstructure. The tie bracket further includes two bracket ends connected to the center section, each bracket end for engaging with respective ones of adjacent ties. Bottom sides of the bracket ends are configured, when installed, to engage with upper edges of the respective ones of adjacent ties. The metal member can be an L-shaped structural steel bar having plural bolt holes, each respective bolt hole for receiving a respective threaded hook bolt, each respective threaded hook bolt for engaging with the superstructure. The method can further include installing an angled washer at each of the plural bolt holes. The angled washer can be installed on a respective threaded hook bolt between the nut and the L-shaped structural steel bar. An angle of the angled washer is operable to accept a perpendicular installation of the threaded end of the respective threaded hook bolt. The shape and size of the angled washer are operable stay in position during installation. A shank of the threaded hook bolt can include a bend distal from the hook, the bend creating an angle in the threaded hook bolt, the angle being less than 90° to the hook. A shank of the threaded hook bolt can include a bend distal from the hook, the bend creating an angle in the threaded hook bolt, the angle being less than 90° to the hook. The bend can be approximately 15 degrees. The hook can have an enlarged thickness at a bend in the hook, the enlarged thickness being relative to other portions of the hook. The hook end can include a substantially flat surface having a length of approximately 2 inches and configured to engage the flange. The threaded hook bolt can include threads having thread specifications of ¾ inch and 10 UNC, wherein the threads are configured to accept a nut of the same thread specifications. The shank can have an extended length, enabling installation of the hook to the flange when the threaded hook bolt is pre-positioned through the bolt hole and when the nut and the washer are pre-assembled to the threaded end of the threaded hook bolt. Each bracket end of the tie bracket can include a boss with a tie fastener hole that is vertical or at an angle relative to the tie bracket and is operable to accept a nail, a lag screw, or another fastener to secure the bracket end to a respective tie. Each bracket end of the tie bracket can include, along the bottom of the tie bracket, grooves configured to grip an upper edge of a respective tie and resist movement of the tie bracket relative to the respective tie. The center section of the tie bracket can include a flat upper surface, wherein, when the threaded hook bolt is installed in the tie bracket, the flat upper surface is substantially perpendicular to the shank at the threaded end of the threaded hook bolt, and wherein the flat upper surface is configured to engage the nut and, optionally, the washer. The center section of the tie bracket can include a protrusion that extends below bottom surfaces of the bracket ends of the tie bracket and below the top surfaces of adjacent ties, and is configured to position the tie bracket between, and for the protrusion to substantially fill a space between, adjacent ties. The bracket ends of the tie bracket can include side walls extending upward from substantially flat portions of the bracket ends, the side walls providing increased strength of the bracket ends. The superstructure can be a steel superstructure of a bridge. The metal member can be a reinforced L-shaped structural steel bar comprising: plural bolt holes, each respective bolt hole for receiving a respective threaded hook bolt for engaging with the superstructure, each threaded hook bolt engaged with the reinforced L-shaped structural steel bar using a nut and optionally a washer; and plural tie fastener holes, each respective tie fastener hole for accepting a fastener for fastening to a respective tie, each tie fastener hole operable to accept a nail, a lag screw, or another fastener to secure the reinforced L-shaped structural steel bar to a respective tie. The reinforced L-shaped structural steel bar can further include a boss at each of the plural bolt holes, the top surface of the boss angled relative to the respective bolt hole so that the threaded end of the threaded hook bolt is perpendicular to the top surface of the boss. The reinforced L-shaped structural steel bar can further include a tab end and a tab-ready end, the tab end configured to fit into the tab-ready end during installation. The reinforced L-shaped structural steel bar can further include plural stabilizers that connect, and provide structural stabilizing strength to, a bottom portion of the reinforced L-shaped structural steel bar and a side of the reinforced L-shaped structural steel bar.

BRIEF DESCRIPTION OF FIGURES

FIG. 3A is a perspective view of the tie bracket.

FIG. 3B is a side view of the tie bracket.

FIG. 3C is a top view of the tie bracket.

FIG. 3D is a side view of the tie bracket.

FIG. 3E is a cross-sectional side view of the raised section of the tie bracket.

FIG. 3F is a cross-sectional side view of the tie bracket including the boss.

DESCRIPTION

Figure 1A:
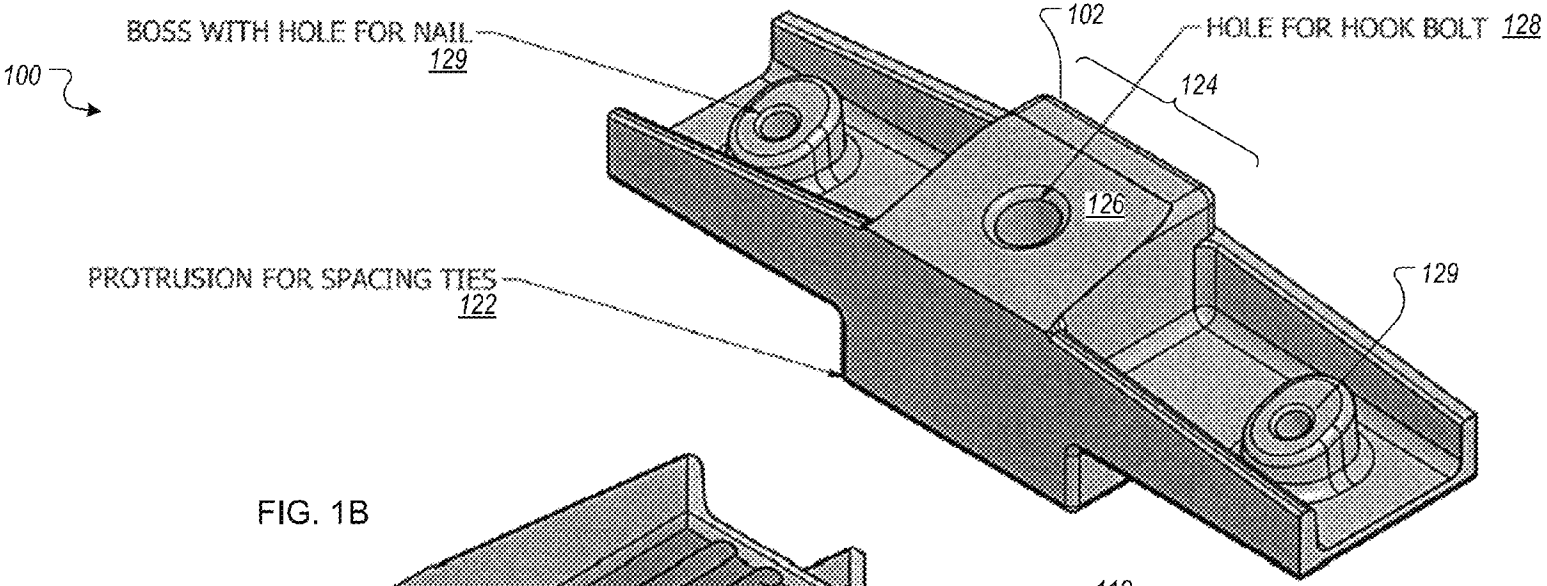
FIGS. 1A and 1B are perspective views of the tie bracket.
Figure 1B:
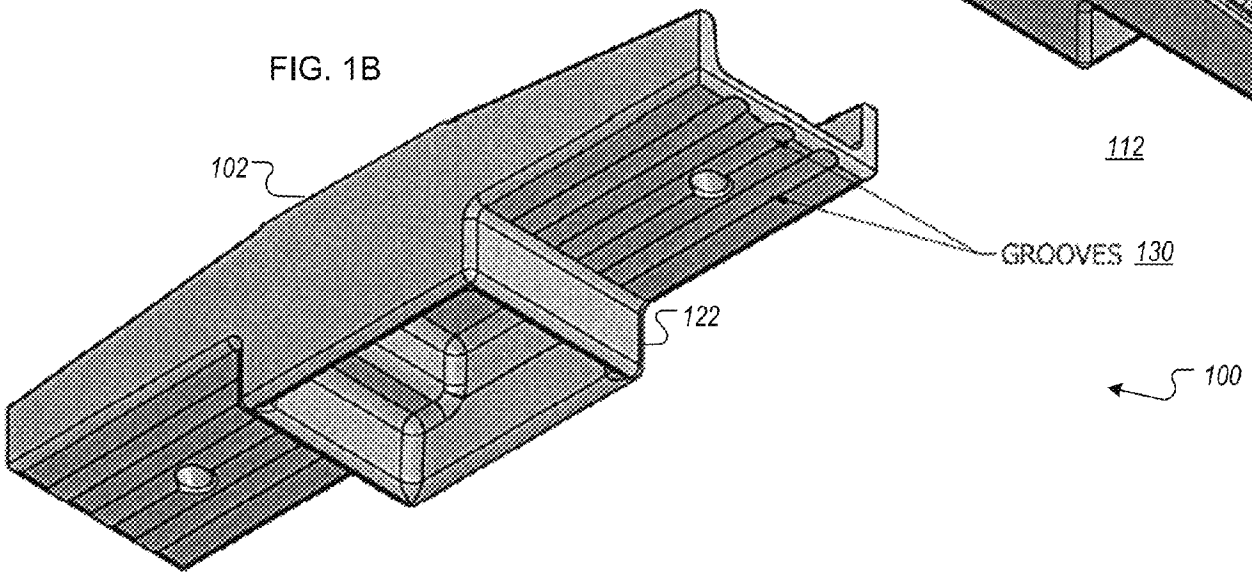
Figure 1C:
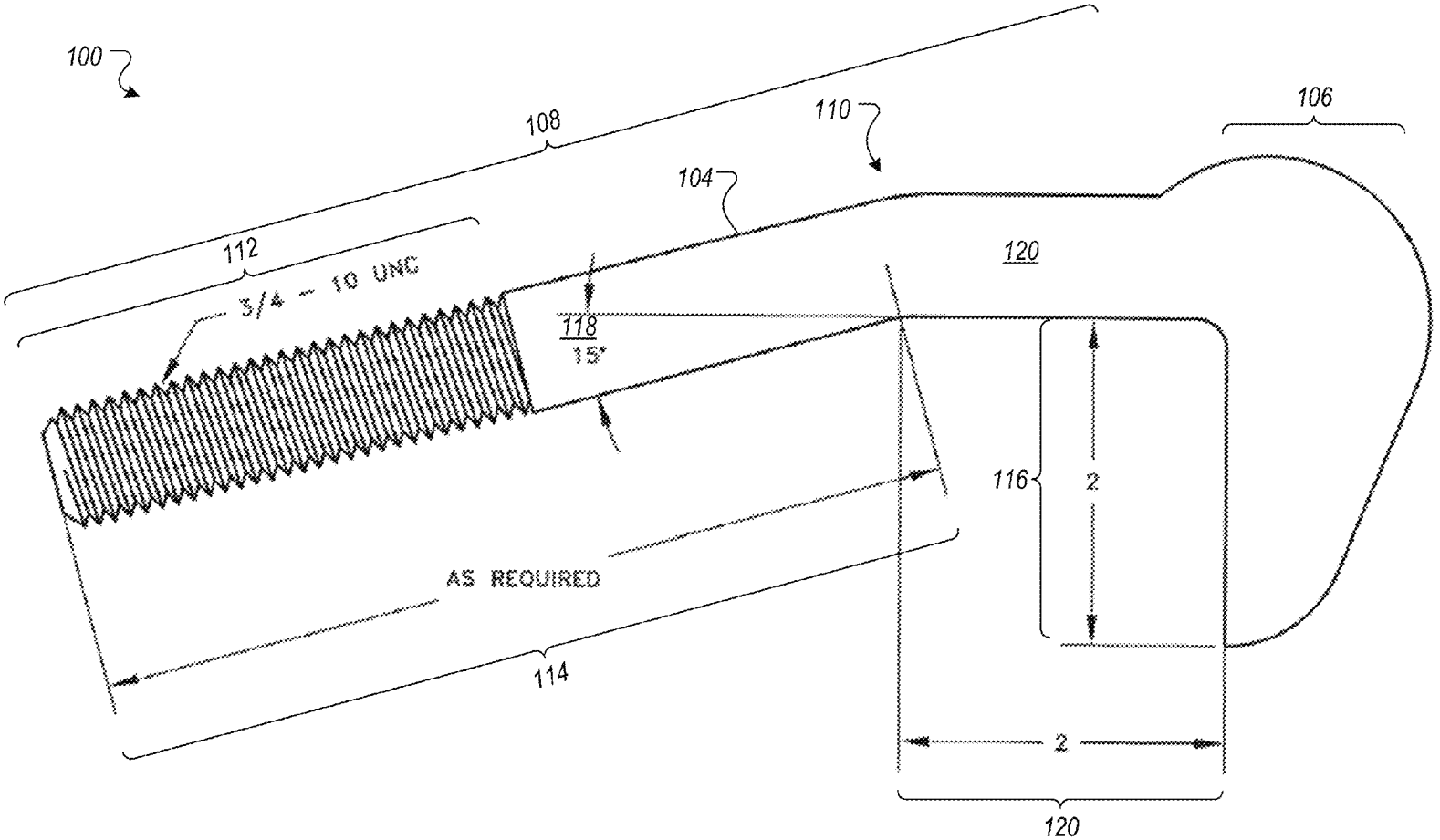
FIG. 1C is a side view of the hook bolt.

FIGS. 1A-1C depict an improved bridge tie fastener system (or "system") 100 and apparatus for anchoring bridge ties to a bridge decking. The system 100 is also a bridge tie retention system because of the advantages that the system 100 provides. In some implementations, the system 100 consists of two primary parts: a tie bracket 102 and a modified hook bolt 104. Specifically, FIGS. 1A and 1B are perspective views of the tie bracket 102, and FIG. 1C is a side view of the hook bolt 104. The tie bracket 102, for example, can serve as a metal member (included in the system 100) for engaging two or more ties, the metal member including a tie fastener hole at one or more locations. Other implementations of the system 100 that do not use the tie bracket 102 are describe below with reference to FIGS. 4A-4B and FIGS. 5A-5C. Other implementations are possible that use the same, or a variation of, the modified hook bolt 104, and that use the tie bracket 102 and/or other components to engage the bridge ties.

The hook bolt 104 has a protrusion (or "hook") 106 on one side of the hook bolt 104 to engage the underside of a flange (e.g., underside of horizontal top portion) of a beam (not shown). A shank 108 of the hook bolt 104 has a bend 110 some distance from the hook 106. This allows the hook 106 to engage the flange and reach above it, then have the bend 110 to form an angle less than 90° to the hook. The other end of the shank 108 is a threaded end 112 to accept a nut (not shown). In some embodiments, the threads of the threaded end 112 are ¾ inch, 10 UNC, e.g., to accept a nut of the same specifications. Other sizes and specifications can be used. In some embodiments, a length 114 of the shank 108 beyond the bend 110 is sufficiently long as required so that the hook bolt 104 can reach above a bridge tie, be inserted through the tie bracket 102, and accept the nut. In some embodiments, the length of the shank 108 can be sufficiently longer to allow the system 100 to be pre-assembled such that the hook bolt 104 is already inserted through the tie bracket 102 and the nut is already attached to the hook bolt 104. The hook 106 can have a hook end 116, e.g., of approximately two inches or a sufficient length to engage the flange of the beam. An angle 118, e.g., 15 degrees, can be the angle of the bend 110 relative to a section 120 (e.g., 2 inches long) of an otherwise straight shank 108.

The tie bracket 102 can be a formed piece (e.g., cast of steel or other suitable material) that spans two adjacent bridge ties. For example, the tie bracket 102 can be made of ductile iron, ASTM A524 GRADE 60/40/18 or equivalent. For ease of casting, corners of the tie bracket 102 can have a radius of ⅙ to ¼ inch, and the tie bracket 102 can include taper surfaces.

The tie bracket 102 has an optional protrusion 122 in the center (of the tie bracket 102) that extends below the top of the tie bracket 102 to fill the space between adjacent bridge ties. In some embodiments, the protrusion 122 may be eliminated from the tie bracket 102. The tie bracket 102 has a raised section 124 in the center with a flat upper surface 126 at an angle perpendicular to the angle of the hook bolt 104. A bolt hole 128 is placed in the center of the flat upper surface 126 at the same angle to allow the hook bolt 104 to pass through. Both ends of the tie bracket 102 have a boss 129 with a tie fastener hole that is vertical or at an angle is operable to accept a nail, a lag screw, or another fastener to secure the tie bracket 102 to the bridge ties. Grooves 130 along the bottom of the tie bracket 102 provide edges to grip an upper surface of a bridge tie and resist movement of the tie bracket 102 relative to the bridge tie.

The tie bracket 102 is positioned on the top of the bridge ties with the hook bolt 104 extending through the bolt hole 128. The hook bolt 104 extends between the bridge ties and hooks onto the beam flange. The tie bracket 102 is secured to the ties with nails, lag screws, or other fasteners in the tie fastener holes provided, and a nut is tightened on the top of the tie bracket 102. This secures the bridge ties to the beam vertically and laterally.

Figure 2A:
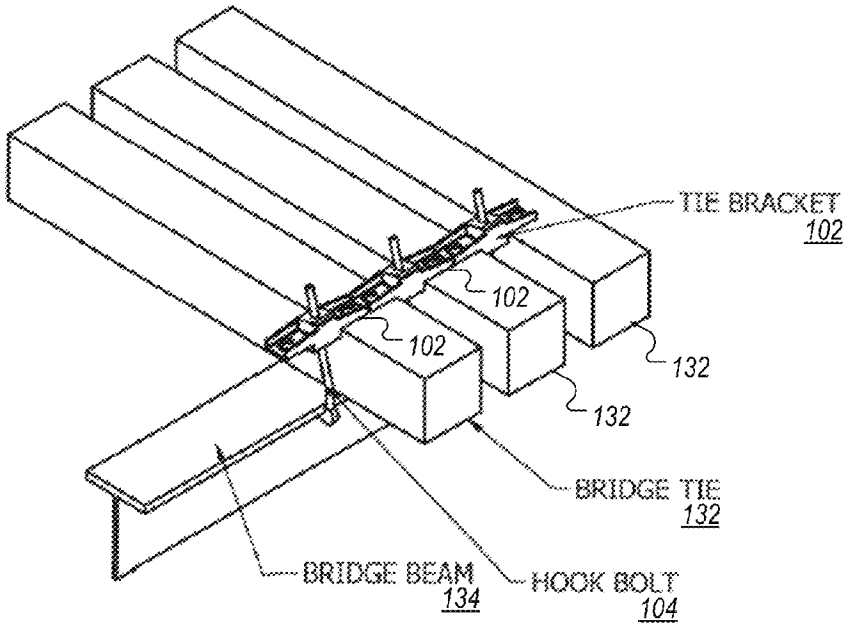
FIG. 2A shows multiple tie brackets being used on adjacent bridge ties on a bridge beam.

FIG. 2A shows multiple tie brackets 102 being used on adjacent bridge ties 132 on a bridge beam 134. In some embodiments (and shown in this example), multiple tie brackets 102 can serve to replace a guard timber used on some bridges. For example, tie brackets 102 can be made in variations (e.g., taller) for enlarged bearing surface when being used in combination to replace (and function as) a guard timber. Lengths of tie bracket 102 can vary so that multiple tie brackets 102 can be butted end-to-end in series and be used for different spacing of adjacent bridge ties.

Figure 2C:
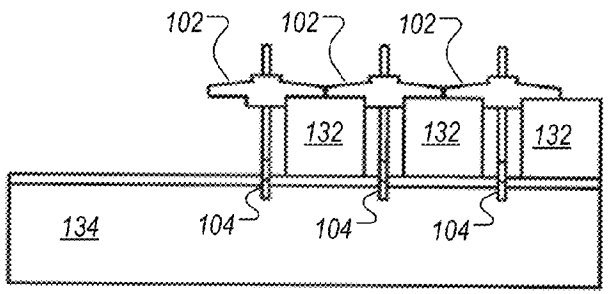
FIG. 2C is a side view of the configuration of the multiple tie brackets shown in FIG. 2A.
Figure 2B:
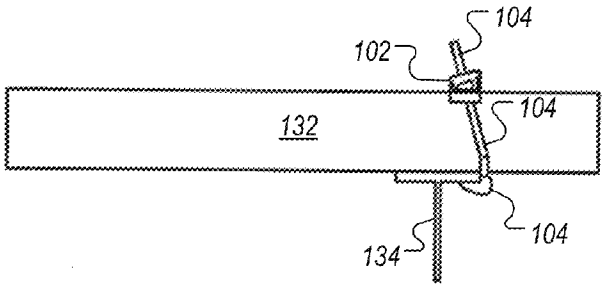
FIG. 2B is a front view of the configuration of the multiple tie brackets shown in FIG. 2A.

FIG. 2B is a front view of the configuration of the multiple tie brackets 102 shown in FIG. 2A. For example, the view shown in FIG. 2B is looking parallel to and down the length of the bridge beam 134.

FIG. 2C is a side view of the configuration of the multiple tie brackets 102 shown in FIG. 2A. For example, the view shown in FIG. 2C is perpendicular to the side of the bridge beam 134 (e.g., looking from the side of the bridge).

FIG. 3A is a perspective view of the tie bracket 102. This view shows the protrusion 122 from the bottom of the tie bracket 102. This view also shows the flat upper surface 126, the bolt hole 128, and the bosses 129 along the top of the tie bracket 102.

FIG. 3B is a side view of the tie bracket 102. This view shows example thicknesses of portions of the tie bracket 102. For example, a tie bracket inside void thickness 140 can be approximately 0.75 inch, a protrusion wall thickness 142 can be approximately 0.25 inch, a tie bracket intermediate thickness 144 can be approximately 0.37 inch, and a tie bracket end thickness 146 can be approximately 0.22 inch. In some embodiments, an angle 148 caused by a gradual tapering of (and formed by an angle between) top and bottom surfaces of the tie bracket 102 can be approximately 2 degrees. Other thicknesses, angles and dimensions are possible.

FIG. 3C is a top view of the tie bracket 102. This view shows an example boss width 150 (e.g., 1.5 inch) and an example boss length 152 (e.g., 1.25 inch). This view also shows an example diameter 154 of the bolt hole 128, e.g., 13/16 inch, which can be slightly larger than the diameter of the shank 108 of the hook bolt 104 and operable to allow its passage. Other dimensions and angles are possible.

FIG. 3D is a side view of the tie bracket 102. This view shows an example length 155 (e.g., 3.0 inches) of the raised section 124. This view also shows an example height 156 (e.g., 1.5 inch) of the tie bracket 102 at a side wall 157 (see FIG. 3A) where the raised section 124 begins. This view also shows an example height 158 (e.g., 1.0 inch) of the side wall 157 at the end of the tie bracket 102. This view also shows an example length 160 (e.g., 4.0 inches) of the protrusion 122, and an example length 162 (e.g., 11.75 inches) of the tie bracket 102. Other lengths of the tie bracket 102 are possible, and lengths can be chosen so that adjacent tie brackets 102 attached to (and mounted on opposite edges of) the same bridge tie can be positioned end-to-end. Longer tie brackets 102 can be used in embodiments in which each bridge tie is attached to only one tie bracket 102 (i.e., at that end of the bridge tie). Other dimensions and angles are possible.

FIG. 3E is a cross-sectional side view of the raised section 124 of the tie bracket 102. This view shows an example angle 164 (e.g., 15 degrees) relative to vertical of an installed tie bracket 102. This view also shows an example back thickness 166 (e.g., 0.25 inch) of protrusion 122, and an example front thickness 168 (e.g., 0.625 inch) of tie bracket 102 below the raised section 124 beneath the bottom of the bolt hole 128. Other dimensions and angles are possible.

FIG. 3F is a cross-sectional side view of the tie bracket 102 including the boss 129. This view shows an example angle 170 (e.g., 15 degrees, relative to horizontal) of the top of the raised section 124. This view also shows an example angle 172 (e.g., 20 degrees, relative to horizontal) of the top of the boss 129, having an example height 174 (e.g., 1.19 inch). This angle is perpendicular to a tie fastener hole 175 through the boss 129 for accepting a nail, a lag screw, or another fastener. This view also shows an example width 176 (e.g., 3.0 inches) of tie bracket 102 below the raised section 124, and an example height 178 (e.g., 2.13 inches) of tie bracket 102 at the raised section 124. Other dimensions and angles are possible.

Figure 4A:
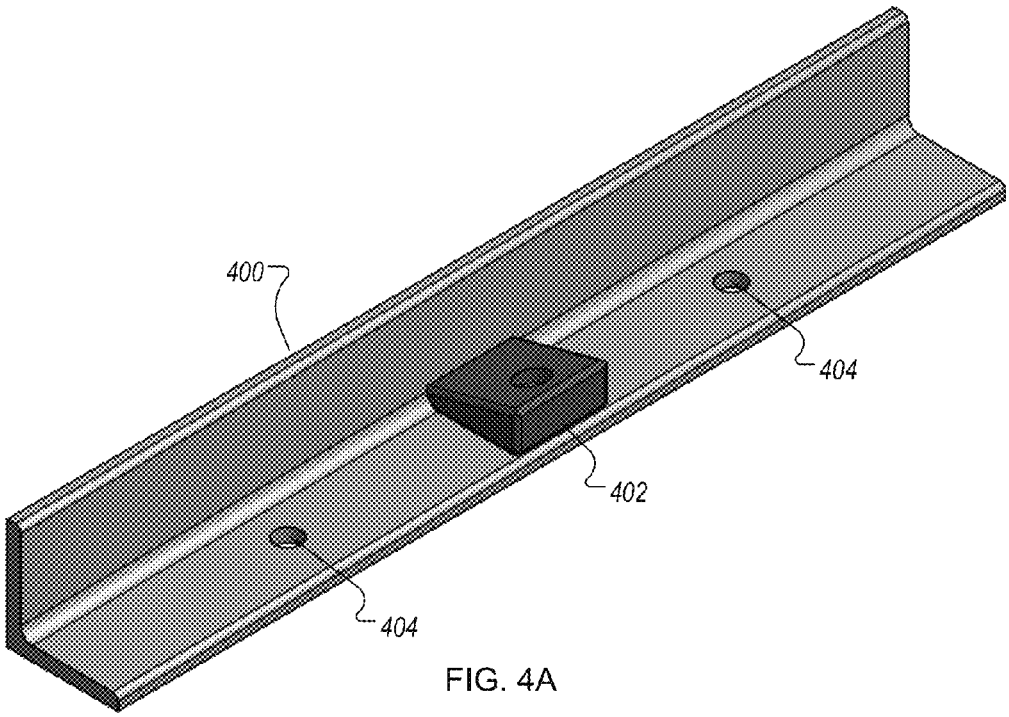
FIGS. 4A and 4B are perspective views of an L-shaped structural steel bar.
Figure 4B:
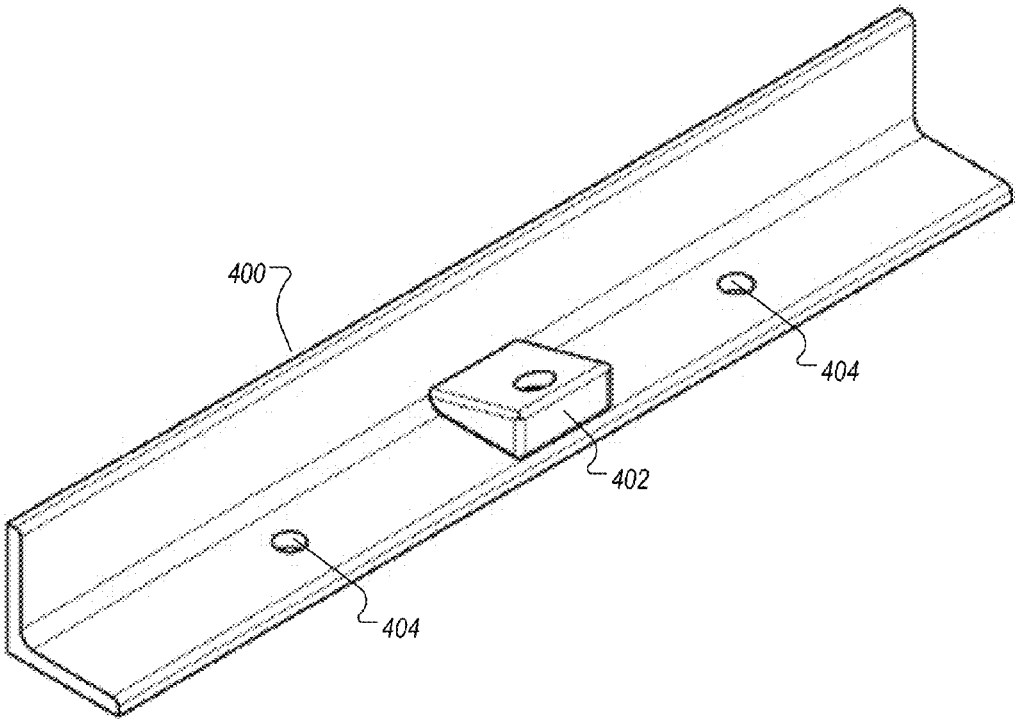

FIGS. 4A and 4B are perspective views of an L-shaped structural steel bar 400. In some implementations, the L-shaped structural steel bar 400 can replace the tie bracket 102 as a metal member for engaging two or more ties (e.g., bridge ties). For example, the metal member can be the L-shaped structural steel bar having plural bolt holes 404. Each respective bolt hole 404 can receive a respective threaded hook bolt (e.g., the hook bolt 104). Each respective threaded hook bolt can be operable to engage with the superstructure. Other shapes and configurations of bars are possible, such as bars to be used instead of, or in addition to, the L-shaped structural steel bar 400. L-shaped structural steel bars 400 can be manufactured in different sizes, different lengths, and with or without holes pre-drilled for ease of installation. Each L-shaped structural steel bar 400 can be sized to engage two or more ties.

In some implementations, including implementations using the L-shaped structural steel bar 400, for example, the system 100 can include an angled washer 402. The angled washer 402 can be operable for installation on a respective threaded hook bolt (e.g., the hook bolt 104) between the nut and the L-shaped structural steel bar, an angle of the angled washer operable to accept a perpendicular installation of the threaded end of the respective threaded hook bolt, the shape and size of the angled washer operable stay in position during installation, and wherein a shank of the threaded hook bolt includes a bend distal from the hook, the bend creating an angle in the threaded hook bolt, the angle being less than 90° to the hook. For example, the shape, size, and position of installation of angled washers 402 can be determined such that a substantially straight side of the angled washer 402 engages with a side wall of the L-shaped structural steel bar 400 to prevent turning of the washer during installation.

Figure 5A:
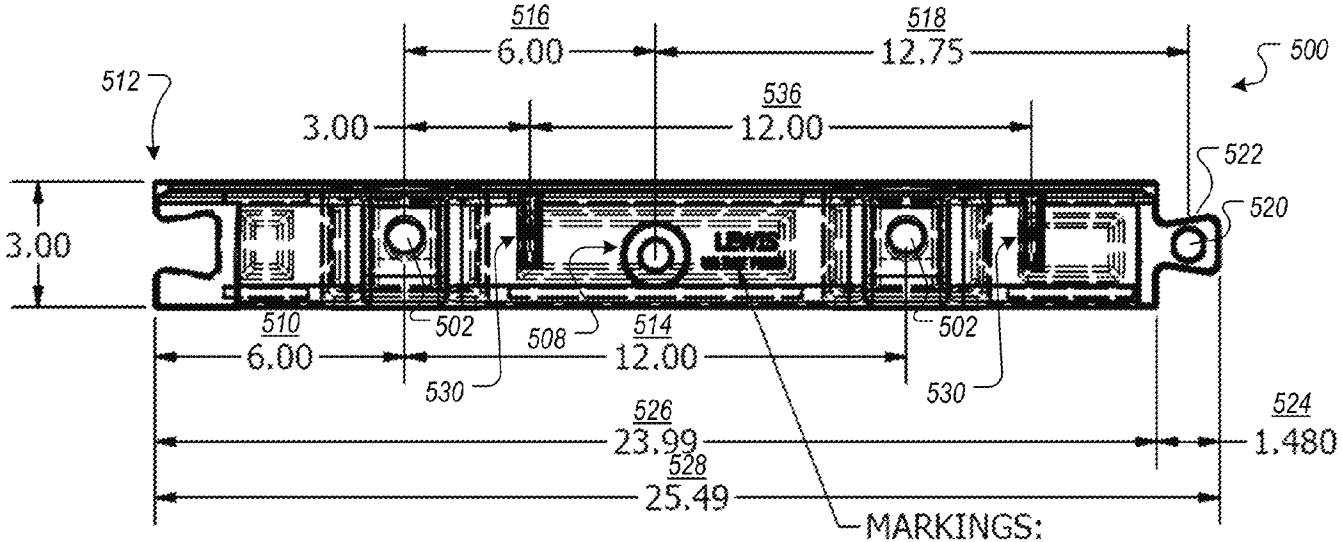
FIG. 5A is a top view of a multi-hook bracket.
Figure 5B:
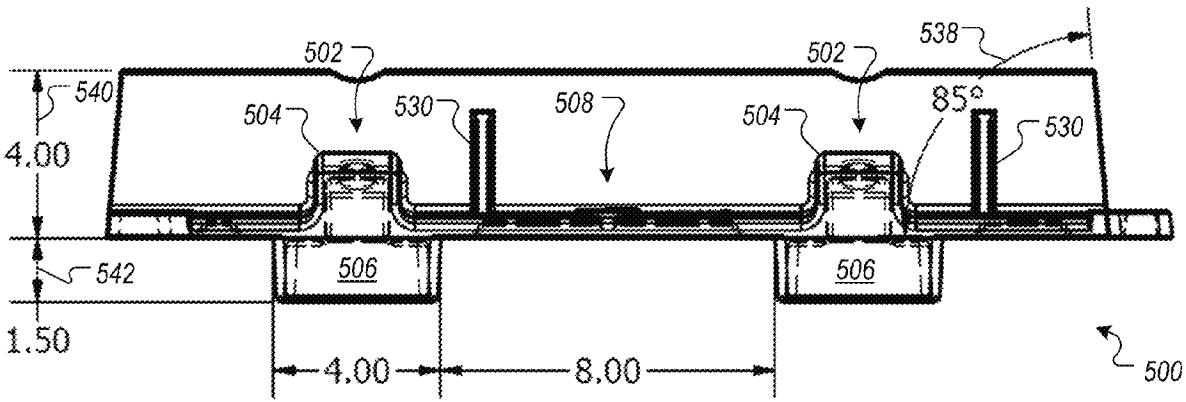
FIG. 5B is a side view of the multi-hook bracket shown in FIG. 5A.
Figure 5C:
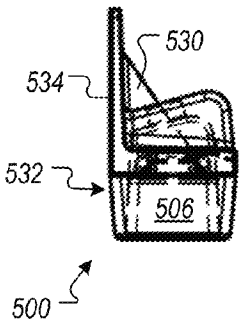
FIG. 5C is an end view of the multi-hook bracket shown in FIG. 5A.

FIG. 5A is a top view of a multi-hook bracket 500. FIG. 5B is a side view of the multi-hook bracket 500 shown in FIG. 5A. FIG. 5C is an end view of the multi-hook bracket 500 shown in FIG. 5A. In some implementations, the multi-hook bracket 500 can be used instead of the tie bracket 102 and/or the L-shaped structural steel bar 400, e.g., in different embodiments of the system 100. As shown in FIG. 5A, the multi-hook bracket 500 includes two bolt holes 502, each bolt hole 502 for accepting the threaded end of the hook bolt 104. Other lengths of the multi-hook bracket 500 are possible, e.g., for accepting more than two hook bolts 104 and for spanning more than two bridge ties. As described above, the other end of each hook bolt 104 can be engaged to the superstructure, such as to the superstructure of a bridge. Each bolt hole 502 is formed below a boss 504 that can be similar (e.g., in dimension, angle, etc.) to the boss 129 as described above. Optional protrusions 506 can exist below each of the bolt holes 502, each protrusion 506 extending below the top of the multi-hook bracket 500 to fill the space between adjacent bridge ties, as described above with respect to FIGS. 1A-1C.

The multi-hook bracket 500 includes at least one tie fastener hole 508, e.g., for fastening the multi-hook bracket 500 to bridge ties using a nail, a lag bolt, or some other fastener. There can be one tie fastener hole 508 between each adjacent pair of bolt holes 502. One additional tie fastener hole 508 can exist on either end of the multi-hook bracket 500, e.g., between either of the end bolt holes 502 and the respective end of the multi-hook bracket 500.

In some implementations, a length 510 from the center of the bolt hole 502 to a tab-ready end 512 can be, for example, 6.0 inches. A bolt hole spacing length 514 can be, e.g., 12.0 inches, to match a corresponding spacing of gaps between bridge ties. As such, a length 516 between a bolt hole 502 and a tie fastener hole 508 can be 6.0 inches. A length 518 between the tie fastener hole 508 and a tab hole 520 in a tab 522 can be, for example, 12.75 inches. For example, the tab 522 can fit into the tab-ready end 512 during installation of two adjacent multi-hook brackets 500. The tab 522 can have a length 524, for example, of 1.48 inches, e.g., to match (and fit together with) dimensions of the tab-ready end 512. A bracket length 526, e.g., 23.99 inches, can be the length of the multi-hook bracket 500 without the tab 522. A bracket-plus-tab length 528, e.g., 25.49 inches, can be the length of the multi-hook bracket 500 including the tab 522. In some implementations, dimensions of the multi-hook bracket 500 can vary to adapt to different lengths of the multi-hook bracket 500 as well as spacing of ties. In some implementations, some of the components of the multi-hook bracket 500 can be manufactured as separate pieces to allow for different configurations and installations of the system, e.g., based on tie spacing and/or other factors.

Some implementations of the multi-hook bracket 500 include a stabilizer 530 that connects, at regular intervals, a bottom portion 532 of the multi-hook bracket 500 to a side portion 534 of the multi-hook bracket 500. The stabilizer 530, e.g., shaped primarily as a triangle with two sides contacting the multi-hook bracket 500, can be forged into the rest of the multi-hook bracket 500 at the time of manufacture. A stabilizer spacing length 536, e.g., 12 inches, can be the distance between pairs of adjacent stabilizers 530. An angle 538 (e.g., 85 degrees) indicates an angle to which the side portion 534 can be manufactured (e.g., back-cut) to avoid crowding of adjacent multi-hook bracket 500 when attaching the tab 522 to the tab-ready end 512.

In some implementations, the multi-hook bracket 500 can have a height 540 (e.g., 4.0 inches), the height 540 not including a height 542 (e.g., 1.5 inches) of the optional protrusion 506.

Figure 6:
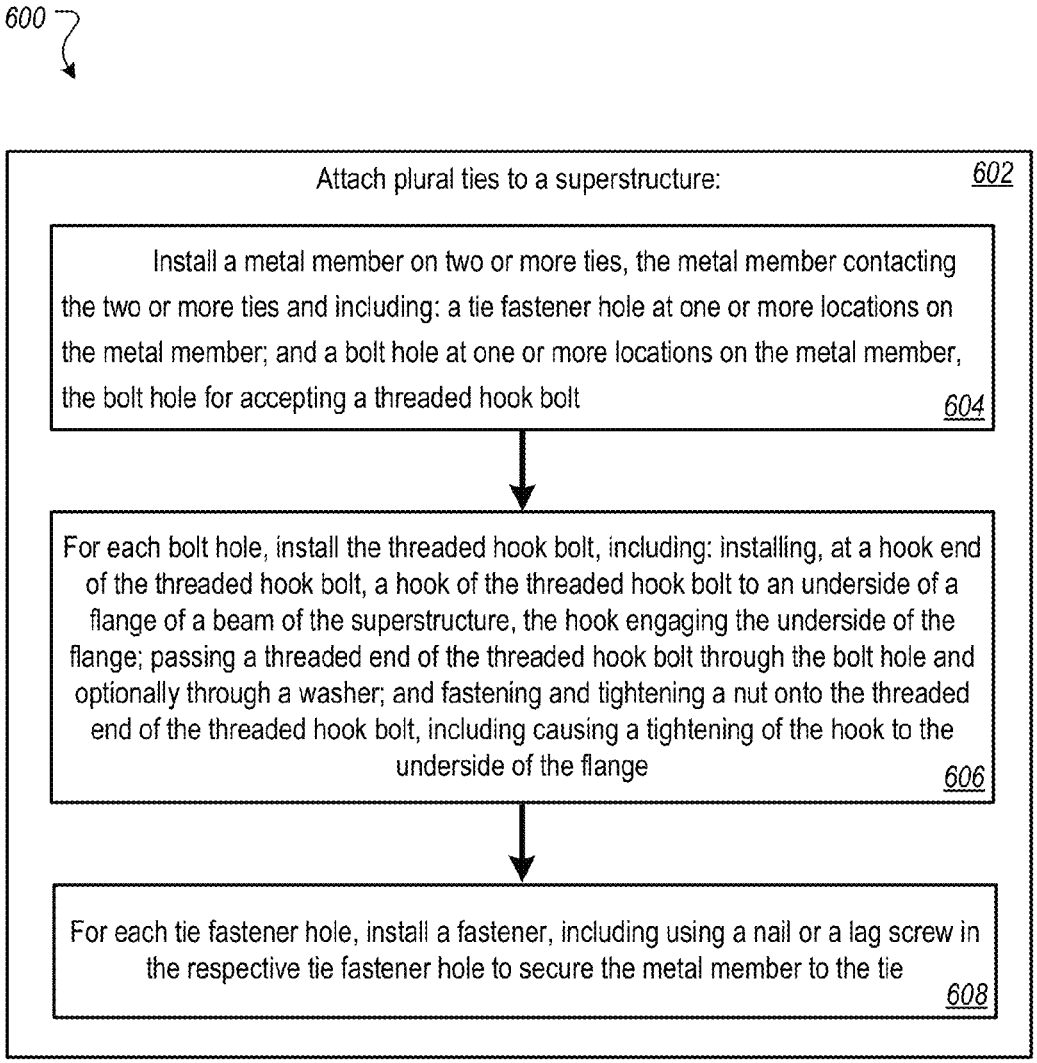
FIG. 6 is a flow diagram of an example process for installing plural ties on a superstructure.

FIG. 6 is a flow diagram of an example process 600 for installing plural ties on a superstructure. For example, the process 600 can be used to install bridge ties on a railroad bridge superstructure, as described above. FIGS. 1-5C and the corresponding descriptions provide example structures for performing the process 600. Other structures can be used.

At 602, plural ties are attached to a superstructure, including the following steps 604-608. Attaching the plural ties to the superstructure occurs from above the superstructure without drilling holes in the ties or the superstructure and without requiring manned installation from below the superstructure.

At 604, a metal member is installed on two or more ties, the metal member contacting the two or more ties and including a tie fastener hole at one or more locations on the metal member and a bolt hole at one or more locations on the metal member, the bolt hole for accepting a threaded hook bolt. The metal member, for example, can be the tie bracket 102, the L-shaped structural steel bar 400, or the multi-hook bracket 500, described above.

At 606, for each bolt hole, the threaded hook bolt is installed, including: installing, at a hook end of the threaded hook bolt, a hook of the threaded hook bolt to an underside of a flange of a beam of the superstructure, the hook engaging the underside of the flange; passing a threaded end of the threaded hook bolt through the bolt hole and optionally through a washer; and fastening and tightening a nut onto the threaded end of the threaded hook bolt, including causing a tightening of the hook to the underside of the flange. For example, installation can occur for the bolt holes in the tie bracket 102, the L-shaped structural steel bar 400, or the multi-hook bracket 500, described above.

At 608, for each tie fastener hole, installing a fastener, including using a nail or a lag screw in the respective tie fastener hole to secure the metal member to the tie. For example, installation can occur for the tie fastener holes in the tie bracket 102, the L-shaped structural steel bar 400, or the multi-hook bracket 500, described above.

In some implementations, the metal member can be a tie bracket (e.g., the tie bracket 102). The tie bracket can include a center section, including the tie fastener hole for receiving the threaded hook bolt. The center section is operable to engage with the threaded hook bolt for fastening to the superstructure. The tie bracket can further include two bracket ends connected to the center section, each bracket end for engaging with respective ones of adjacent ties. Bottom sides of the bracket ends can be configured, when installed, to engage with upper edges of the respective ones of adjacent ties.

In some implementations, the metal member can be an L-shaped structural steel bar (e.g., the L-shaped structural steel bar 400) having plural bolt holes, each respective bolt hole for receiving a respective threaded hook bolt, each respective threaded hook bolt for engaging with the superstructure.

In some implementations, the method can further include installing an angled washer (e.g., the angled washer 402) at each of the plural bolt holes. The angled washer can be installed on a respective threaded hook bolt between the nut and the L-shaped structural steel bar. An angle of the angled washer can be operable to accept a perpendicular installation of the threaded end of the respective threaded hook bolt. The shape and size of the angled washer can be operable stay in position during installation.

In some implementations, a shank of the threaded hook bolt (e.g., the hook bolt 104) can include a bend distal from the hook, the bend creating an angle in the threaded hook bolt, the angle being less than 90° to the hook.

In some implementations, a shank of the threaded hook bolt (e.g., the hook bolt 104) can include a bend distal from the hook, the bend creating an angle in the threaded hook bolt, the angle being less than 90° to the hook. The bend can be approximately 15 degrees.

In some implementations, the hook (e.g., the hook 106) can have an enlarged thickness at a bend in the hook, the enlarged thickness being relative to other portions of the hook.

In some implementations, the hook end (e.g., the hook end 116) can include a substantially flat surface having a length of approximately 2 inches and configured to engage the flange.

In some implementations, the threaded hook bolt (e.g., the hook bolt 104) can include threads having thread specifications of ¾ inch and 10 UNC, wherein the threads are configured to accept a nut of the same thread specifications.

In some implementations, the shank (e.g., of the hook bolt 104) can have an extended length, enabling installation of the hook to the flange when the threaded hook bolt is pre-positioned through the bolt hole and when the nut and the washer are pre-assembled to the threaded end of the threaded hook bolt.

In some implementations, each bracket end of the tie bracket (e.g., the tie bracket 102) can include a boss with a tie fastener hole that is vertical or at an angle relative to the tie bracket and is operable to accept a nail, a lag screw, or another fastener to secure the bracket end to a respective tie.

In some implementations, each bracket end of the tie bracket (e.g., the tie bracket 102) can include, along the bottom of the tie bracket, grooves configured to grip an upper edge of a respective tie and resist movement of the tie bracket relative to the respective tie.

In some implementations, the center section of the tie bracket (e.g., the tie bracket 102) can include a flat upper surface, wherein, when the threaded hook bolt is installed in the tie bracket, the flat upper surface is substantially perpendicular to the shank at the threaded end of the threaded hook bolt, and wherein the flat upper surface is configured to engage the nut and, optionally, the washer.

In some implementations, the center section of the tie bracket (e.g., the tie bracket 102) can include a protrusion that extends below bottom surfaces of the bracket ends of the tie bracket and below the top surfaces of adjacent ties, and is configured to position the tie bracket between, and for the protrusion to substantially fill a space between, adjacent ties.

In some implementations, the bracket ends of the tie bracket (e.g., the tie bracket 102) can include side walls extending upward from substantially flat portions of the bracket ends, the side walls providing increased strength of the bracket ends.

In some implementations, the superstructure can be a steel superstructure of a bridge.

In some implementations, the metal member can be a reinforced L-shaped structural steel bar (e.g., the multi-hook bracket 500). The reinforced L-shaped structural steel bar can include plural bolt holes, each respective bolt hole for receiving a respective threaded hook bolt for engaging with the superstructure, each threaded hook bolt engaged with the reinforced L-shaped structural steel bar using a nut and optionally a washer. The reinforced L-shaped structural steel bar can include plural tie fastener holes, each respective tie fastener hole for accepting a fastener for fastening to a respective tie, each tie fastener hole operable to accept a nail, a lag screw, or another fastener to secure the reinforced L-shaped structural steel bar to a respective tie.

In some implementations, the reinforced L-shaped structural steel bar (e.g., the multi-hook bracket 500) can further include a boss at each of the plural bolt holes, the top surface of the boss angled relative to the respective bolt hole so that the threaded end of the threaded hook bolt is perpendicular to the top surface of the boss.

In some implementations, the reinforced L-shaped structural steel bar (e.g., the multi-hook bracket 500) can further include a tab end and a tab-ready end, the tab end configured to fit into the tab-ready end during installation.

In some implementations, the reinforced L-shaped structural steel bar (e.g., the multi-hook bracket 500) can further include plural stabilizers that connect, and provide structural stabilizing strength to, a bottom portion of the reinforced L-shaped structural steel bar and a side of the reinforced L-shaped structural steel bar.

The present disclosure describes some embodiments of the system 100. Other embodiments are possible.

What is claimed is:

1. A tie fastener apparatus for attaching railroad ties to a superstructure, the tie fastener apparatus comprising:

a threaded hook bolt, including a hook on one end of the threaded hook bolt, the hook including a hook end configured to engage the underside of a flange of a beam of the superstructure;

a metal member for engaging two or more ties, the metal member including a tie fastener hole at one or more locations; and a nut configured to be fastened to a threaded end of the threaded hook bolt for installation when the threaded hook bolt is passed through the bolt hole and optionally through a washer;

wherein, when the threaded hook bolt is installed, including passing a threaded end of the threaded hook bolt through the bolt hole and fastening with the nut, the hook engages the superstructure; and wherein the tie fastener apparatus is configured to be installed from above the superstructure without drilling holes in the ties or the superstructure and without requiring manned installation from below the superstructure.

2. The tie fastener apparatus of claim 1, wherein the metal member is a tie bracket including:

a center section, including the tie fastener hole for receiving the threaded hook bolt, the center section operable to engage with the threaded hook bolt for fastening to the superstructure; and two bracket ends connected to the center section, each bracket end for engaging with respective ones of adjacent ties;

wherein bottom sides of the bracket ends are configured, when installed, to engage with upper edges of the respective ones of adjacent ties.

3. The tie fastener apparatus of claim 1, wherein the metal member is an L-shaped structural steel bar having plural bolt holes, each respective bolt hole for receiving a respective threaded hook bolt, each respective threaded hook bolt for engaging with the superstructure.

4. The tie fastener apparatus of claim 3, further comprising an angled washer operable for installation on a respective threaded hook bolt between the nut and the L-shaped structural steel bar, an angle of the angled washer operable to accept a perpendicular installation of the threaded end of the respective threaded hook bolt, the shape and size of the angled washer operable stay in position during installation, and wherein a shank of the threaded hook bolt includes a bend distal from the hook, the bend creating an angle in the threaded hook bolt, the angle being less than 90° to the hook.

5. The tie fastener apparatus of claim 1, wherein a shank of the threaded hook bolt includes a bend distal from the hook, the bend creating an angle in the threaded hook bolt, the angle being less than 90° to the hook.

6. The tie fastener apparatus of claim 4 or claim 5, wherein the bend is approximately 15 degrees.

7. The tie fastener apparatus of claim 1, wherein the hook has an enlarged thickness at a bend in the hook, the enlarged thickness being relative to other portions of the hook.

8. The tie fastener apparatus of claim 1, wherein the hook end includes a substantially flat surface having a length of approximately 2 inches and configured to engage the flange.

9. The tie fastener apparatus of claim 1, wherein the threaded hook bolt includes threads having thread specifications of ¾ inch and 10 UNC, and wherein the threads are configured to accept a nut of the same thread specifications.

10. The tie fastener apparatus of claim 1, wherein the shank has an extended length, enabling installation of the hook to the flange when the threaded hook bolt is pre-positioned through the bolt hole and when the nut and the washer are pre-assembled to the threaded end of the threaded hook bolt.

11. The tie fastener apparatus of claim 2, wherein each bracket end of the tie bracket includes a boss with a tie fastener hole that is vertical or at an angle relative to the tie bracket and is operable to accept a nail, a lag screw, or another fastener to secure the bracket end to a respective tie.

12. The tie fastener apparatus of claim 2, wherein each bracket end of the tie bracket includes, along the bottom of the tie bracket, grooves configured to grip an upper edge of a respective tie and resist movement of the tie bracket relative to the respective tie.

13. The tie fastener apparatus of claim 2, wherein the center section of the tie bracket includes a flat upper surface, wherein, when the threaded hook bolt is installed in the tie bracket, the flat upper surface is substantially perpendicular to the shank at the threaded end of the threaded hook bolt, and wherein the flat upper surface is configured to engage the nut and, optionally, the washer.

14. The tie fastener apparatus of claim 2, wherein the center section of the tie bracket includes a protrusion that extends below bottom surfaces of the bracket ends of the tie bracket and below the top surfaces of adjacent ties, and is configured to position the tie bracket between, and for the protrusion to substantially fill a space between, adjacent ties.

15. The tie fastener apparatus of claim 2, wherein the bracket ends of the tie bracket include side walls extending upward from substantially flat portions of the bracket ends, the side walls providing increased strength of the bracket ends.

16. The tie fastener apparatus of claim 1, wherein the superstructure is a steel superstructure of a bridge.

17. The tie fastener apparatus of claim 1, wherein the metal member is a reinforced L-shaped structural steel bar comprising:

plural bolt holes, each respective bolt hole for receiving a respective threaded hook bolt for engaging with the superstructure, each threaded hook bolt engaged with the reinforced L-shaped structural steel bar using a nut and optionally a washer; and plural tie fastener holes, each respective tie fastener hole for accepting a fastener for fastening to a respective tie, each tie fastener hole operable to accept a nail, a lag screw, or another fastener to secure the reinforced L-shaped structural steel bar to a respective tie.

18. The tie fastener apparatus of claim 17, further comprising a boss at each of the plural bolt holes, the top surface of the boss angled relative to the respective bolt hole so that the threaded end of the threaded hook bolt is perpendicular to the top surface of the boss.

19. The tie fastener apparatus of claim 17, further comprising a tab end and a tab-ready end, the tab end configured to fit into the tab-ready end during installation.

20. The tie fastener apparatus of claim 17, further comprising stabilizers that connect, and provide structural stabilizing strength to, a bottom portion of the reinforced L-shaped structural steel bar and a side of the reinforced L-shaped structural steel bar.

21. A method comprising:

attaching plural ties to a superstructure, including:

installing a metal member on two or more ties, the metal member contacting the two or more ties and including:

a tie fastener hole at one or more locations on the metal member; and a bolt hole at one or more locations on the metal member, the bolt hole for accepting a threaded hook bolt;

for each bolt hole, installing the threaded hook bolt, including:

installing, at a hook end of the threaded hook bolt, a hook of the threaded hook bolt to an underside of a flange of a beam of the superstructure, the hook engaging the underside of the flange;

passing a threaded end of the threaded hook bolt through the bolt hole and optionally through a washer; and fastening and tightening a nut onto the threaded end of the threaded hook bolt, including causing a tightening of the hook to the underside of the flange; and for each tie fastener hole, installing a fastener, including using a nail or a lag screw in the respective tie fastener hole to secure the metal member to the tie;

wherein attaching the plural ties to the superstructure occurs from above the superstructure without drilling holes in the ties or the superstructure and without requiring manned installation from below the superstructure.

22. The method of claim 21, wherein the metal member is a tie bracket including:

a center section, including the tie fastener hole for receiving the threaded hook bolt, the center section operable to engage with the threaded hook bolt for fastening to the superstructure; and two bracket ends connected to the center section, each bracket end for engaging with respective ones of adjacent ties;

wherein bottom sides of the bracket ends are configured, when installed, to engage with upper edges of the respective ones of adjacent ties.

23. The method of claim 21, wherein the metal member is an L-shaped structural steel bar having plural bolt holes, each respective bolt hole for receiving a respective threaded hook bolt, each respective threaded hook bolt for engaging with the superstructure.

24. The method of claim 23, further comprising installing an angled washer at each of the plural bolt holes, the angled washer installed on a respective threaded hook bolt between the nut and the L-shaped structural steel bar, an angle of the angled washer operable to accept a perpendicular installation of the threaded end of the respective threaded hook bolt, the shape and size of the angled washer operable stay in position during installation, and wherein a shank of the threaded hook bolt includes a bend distal from the hook, the bend creating an angle in the threaded hook bolt, the angle being less than 90° to the hook.

25. The method of claim 21, wherein a shank of the threaded hook bolt includes a bend distal from the hook, the bend creating an angle in the threaded hook bolt, the angle being less than 90° to the hook.

26. The method of claim 24 or claim 25, wherein the bend is approximately 15 degrees.

27. The method of claim 21, wherein the hook has an enlarged thickness at a bend in the hook, the enlarged thickness being relative to other portions of the hook.

28. The method of claim 21, wherein the hook end includes a substantially flat surface having a length of approximately 2 inches and configured to engage the flange.

29. The method of claim 21, wherein the threaded hook bolt includes threads having thread specifications of ¾ inch and 10 UNC, and wherein the threads are configured to accept a nut of the same thread specifications.

30. The method of claim 21, wherein the shank has an extended length, enabling installation of the hook to the flange when the threaded hook bolt is pre-positioned through the bolt hole and when the nut and the washer are pre-assembled to the threaded end of the threaded hook bolt.

31. The method of claim 22, wherein each bracket end of the tie bracket includes a boss with a tie fastener hole that is vertical or at an angle relative to the tie bracket and is operable to accept a nail, a lag screw, or another fastener to secure the bracket end to a respective tie.

32. The method of claim 22, wherein each bracket end of the tie bracket includes, along the bottom of the tie bracket, grooves configured to grip an upper edge of a respective tie and resist movement of the tie bracket relative to the respective tie.

33. The method of claim 22, wherein the center section of the tie bracket includes a flat upper surface, wherein, when the threaded hook bolt is installed in the tie bracket, the flat upper surface is substantially perpendicular to the shank at the threaded end of the threaded hook bolt, and wherein the flat upper surface is configured to engage the nut and, optionally, the washer.

34. The method of claim 22, wherein the center section of the tie bracket includes a protrusion that extends below bottom surfaces of the bracket ends of the tie bracket and below the top surfaces of adjacent ties, and is configured to position the tie bracket between, and for the protrusion to substantially fill a space between, adjacent ties.

35. The method of claim 22, wherein the bracket ends of the tie bracket include side walls extending upward from substantially flat portions of the bracket ends, the side walls providing increased strength of the bracket ends.

36. The method of claim 21, wherein the superstructure is a steel superstructure of a bridge.

37. The method of claim 21, wherein the metal member is a reinforced L-shaped structural steel bar comprising:

plural bolt holes, each respective bolt hole for receiving a respective threaded hook bolt for engaging with the superstructure, each threaded hook bolt engaged with the reinforced L-shaped structural steel bar using a nut and optionally a washer; and plural tie fastener holes, each respective tie fastener hole for accepting a fastener for fastening to a respective tie, each tie fastener hole operable to accept a nail, a lag screw, or another fastener to secure the reinforced L-shaped structural steel bar to a respective tie.

38. The method of claim 37, wherein the reinforced L-shaped structural steel bar further comprises a boss at each of the plural bolt holes, the top surface of the boss angled relative to the respective bolt hole so that the threaded end of the threaded hook bolt is perpendicular to the top surface of the boss.

39. The method of claim 37, wherein the reinforced L-shaped structural steel bar further comprises a tab end and a tab-ready end, the tab end configured to fit into the tab-ready end during installation.

40. The method of claim 37, wherein the reinforced L-shaped structural steel bar further comprises plural stabilizers that connect, and provide structural stabilizing strength to, a bottom portion of the reinforced L-shaped structural steel bar and a side of the reinforced L-shaped structural steel bar.

* * * * *